United States Patent [19]

Knox et al.

[11] 4,214,556

[45] Jul. 29, 1980

[54] DEVICE FOR IMMOBILIZING ANIMALS

[76] Inventors: Harry D. Knox, R.R. #1, Barfield Rd., Murfreesboro, Tenn. 37130; James P. Summar, R.R. #2, Box 385, Readyville, Tenn. 37149

[21] Appl. No.: 922,169

[22] Filed: Jul. 3, 1978

[51] Int. Cl.[2] ..... A61D 3/00

[52] U.S. Cl. ..... 119/103

[58] Field of Search ..... 119/98, 99, 100, 103

[56] References Cited

U.S. PATENT DOCUMENTS

| | | | |
|---|---|---|---|
| 53,425 | 3/1866 | Elder et al. | 119/103 |
| 1,073,756 | 9/1913 | Higgason | 119/103 |
| 1,209,549 | 12/1916 | Brown et al. | 119/103 |
| 1,717,532 | 6/1929 | Trees | 119/103 |
| 2,705,475 | 4/1955 | Johnisee | 119/103 |
| 2,829,622 | 4/1958 | Borthwick | 119/103 |

*Primary Examiner*—Louis G. Mancene

*Assistant Examiner*—Robert P. Swiatek

*Attorney, Agent, or Firm*—Clarence A. O'Brien; Harvey B. Jacobson

[57] ABSTRACT

A device is disclosed which is designed to hold animals in a completely immobile state to enable total freedom of an operator to perform various operations on the animal, such as castration, innoculations, surgery, tattooing, or the like. The invention is particularly useful with pigs or other animals of comparable size, which can be transferred to the device of the present invention by a single person without injury to the animal. When used for immobilizing a pig, a flexible cone adjusted to approximate the size of the pig's head retains the animal's head as it is placed on its back in the device. A horizontal bar then slides down to apply firm pressure on the back legs of the pig, now securely immobilized for performing of veterinary operations.

3 Claims, 5 Drawing Figures

DEVICE FOR IMMOBILIZING ANIMALS

BACKGROUND OF THE INVENTION

1. Field of the Invention

The invention relates to a veterinary device, more particularly, to a device for immobilizing animals, such as pigs, to enable an operator to perform a veterinary operation such as castration, innoculation, surgery, tattooing, or the like.

Prior inventions are known for holding animals, such as are described in U.S. Pat. No. 3,137,273, issued June 16, 1964 to Greenwood, showing an animal holding device in a V-shaped platform configuration with a muzzle and leg shackle mounted upon a vertical rod. A disadvantage associated with this device results from failure to provide for adjustment of the muzzle cone. Consequently, in order to be usable for the largest animals typically encountered, the muzzle cone must be large enough to accommodate the head of such an animal, rendering the device unusable for very young animals. Moreover, the device requires a complicated mounting platform, and is not readily portable. Greenwood U.S. Pat. No. 2,914,026, issued Nov. 24, 1959, shows another animal holding device, but without means for containing the head of the aminal, such as a muzzle cone. This device requires a suitably located elongated horizontally disposed member for mounting and consequently cannot be portably moved to a field, barn, or other location where a mounting board of a suitable size and height is unavailable.

U.S. Pat. No. 3,164,131, issued Jan. 5, 1965 to Bradshaw, shows a device for holding an animal on its side with a jig for thrusting the animal's upward rear leg forwardly. The muzzle cone shown in the Bradshaw patent is not adjustable, requiring the operator to group animals in small, medium and large sizes. A further problem arising from use of the Bradshaw device is that certain veterinary operations, such as ear notching or tagging of the lower ear, are not easily performed with the animal lying on its side. U.S. Pat. No. 2,965,071, issued Dec. 20, 1970 to Scott et al, shows an animal cradle with a plurality of straps for holding the animal in a supine position. Since a muzzle and easily adjustable horizontal bar are absent in the Scott et al device, an animal such as a 50 pound pig cannot be expected to be easily secured by a single person into such a device, both hands being required for operation of the pair of levers fulcrumed on the rail for placing straps to hold the animal. Moreover, the opertor's feet must be used to maintain the straps in a tautened state while operating the holding levers.

U.S. Pat. No. 1,089,283, issued Mar. 3, 1914 to Stebbins, shows an operating table for use in animal research, tying each leg of the animal individually and providing no muzzle for securing the head. Considerable effort and time for tying the legs would be expected to result, and for certain animals, such as pigs, sideways spreading of the legs would be undesirable.

SUMMARY OF THE INVENTION

The invention provides a device for overcoming the disadvantages of the prior art by providing a completely adjustable mechanism for holding animals from the smallest sizes to approximately 50 lb. size without injury to the animal and which is lightweight, completely portable, relatively inexpensive, and longlasting with little required maintenance. A frame comprising two crossed leg assemblies and longitudinal cross members is arranged to hold panels in a V-shaped configuration, within which the animal rests. One of the panels has a slot for receiving the material forming the adjustable muzzle cone, and one longitudinal member is adapted for holding adjusting means to both horizontally and vertically adjust the position of a horizontal retaining bar placed in contact with the animal.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
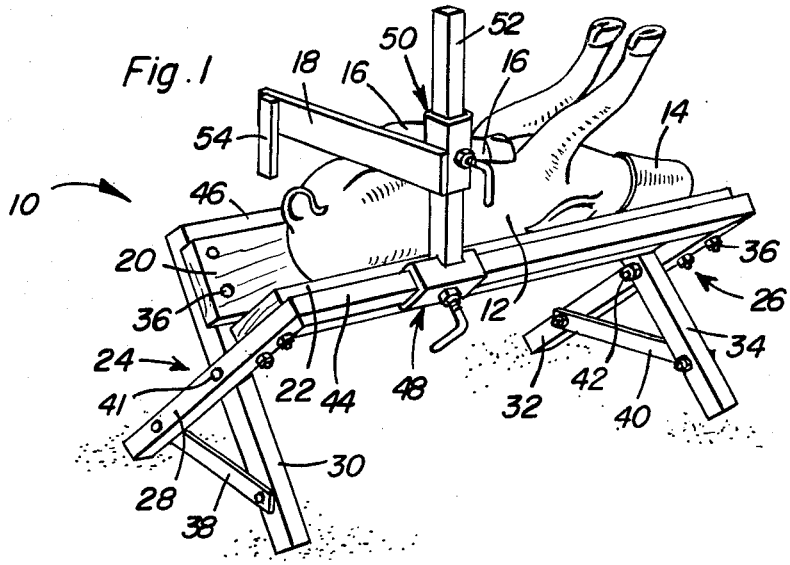
FIG. 1 is a perspective view of the device of the present invention with a small animal or pig shown held in an immobile state.

In FIG. 1, the device of the present invention is designated generally by the numeral 10, in which a pig 12 is held in an immobile state at the head by muzzle cone 14 and by pressure applied upon back legs 16 by horizontal retaining bar 18. Pig 12 rests upon wooden panels 20 and 22, which can be made of oak boards or other suitable materials, such as plastic, metal, or the like. Wooden panels 20 and 22 are held in place upon cross leg assembly 24 and 26, comprising leg members 28, 30, 32 and 34, by suitable fastening means, such as bolts 36. Bracing bars 38 and 40 hold in fixed position the respective leg members 28, 30, 32 and 34, pivotable about pivot bolts 41 and 42, respectively. Longitudinal frame member 44 connects the upper extremity of leg member 28 and leg member 32, to which member 44 is attached by welding or other suitable means. Longitudinal frame member 46 is similarly attached to leg members 30 and 34. Horizontal adjusting means 48 for horizontal adjustment of horizontal retaining bar 18 slides longitudinally along longitudinal frame member 44, while vertical adjusting means 50 for vertical adjustment of horizontal retaining bar 18 slides upwardly or downwardly on post 52. By simultaneous adjustment of horizontal adjusting means 48 and vertical adjusting means 50, horizontal retaining bar 18 is placed upon back legs of pig 12 to apply firm pressure to render the animal immobile. Extension 54 of horizontal retaining bar 18 is provided to facilitate this adjustment by insuring that pig 12 will not roll in the direction away from the operation of adjusting means 48 and 50.

Figure 2:
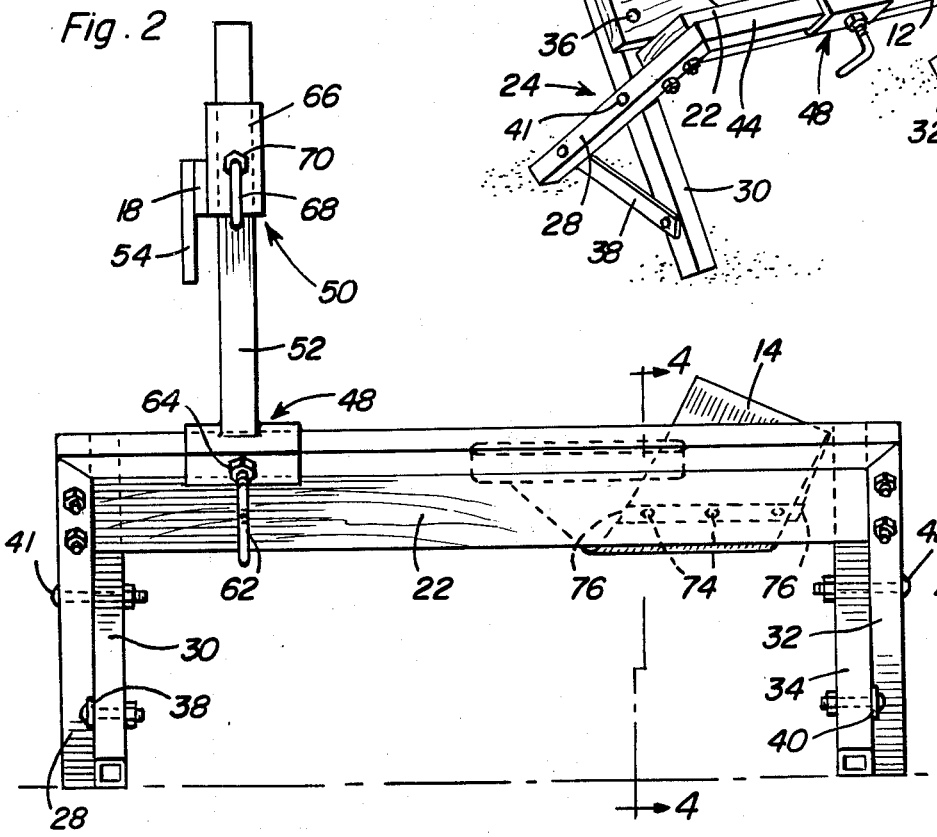
FIG. 2 is a side elevational view of the device of the present invention.
Figure 5:
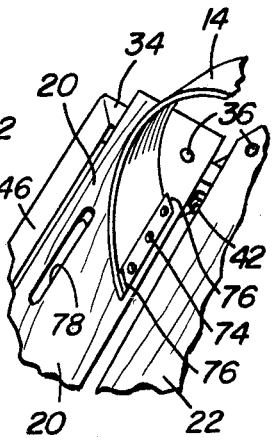
FIG. 5 is an enlarged fragmentary perspective view of the right end portion of the device of FIG. 1, showing details of attachment of the end of the muzzle cone of the present invention.
Figure 3:
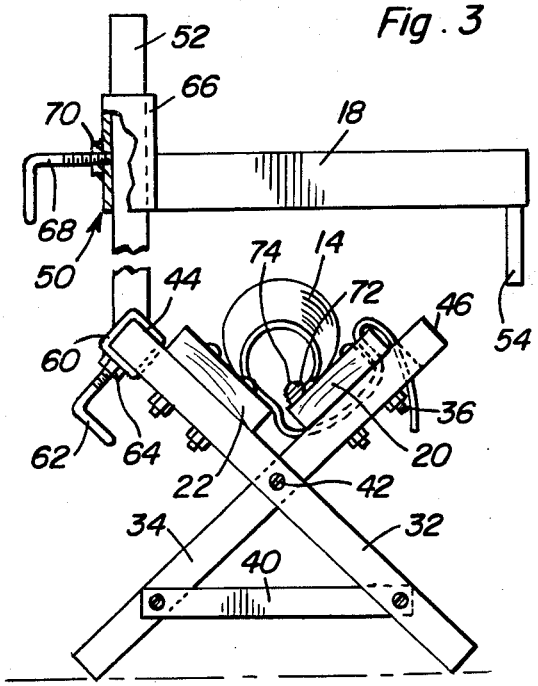
FIG. 3 is an end elevational view, partly broken away in section, of the device of the present invention.

Details of adjusting means 48 and 50, as well as muzzle cone 14, are seen in FIGS. 2 and 3. In FIG. 2, horizontal adjusting means 48 comprises slidable sleeve 60, movable horizontally along longitudinal frame member 44 and tightened thereon by L-shaped set screw 62, threaded through a nut 64 welded onto sleeve 60 in alignment with a hole therein to enable the inner end of the set screw 62 to clampingly engage frame member 44. Post 52 is welded or otherwise attached to slidable sleeve 60, and slidable sleeve 66 is vertically adjustable on post 52, being tightenable thereon by L-shaped set screw 68 threaded through nut 70 into clamping engagement with post 52. The vertical adjusting means 50 including sleeve 66 and set screw 68 is adjusted by the operator to fit the thighs of pig 12 in holding it immobile. Sleeve 66 has welded or otherwise attached to it horizontal retaining bar 18, which similarly holds depending extension 54 at its far end.

Figure 4:
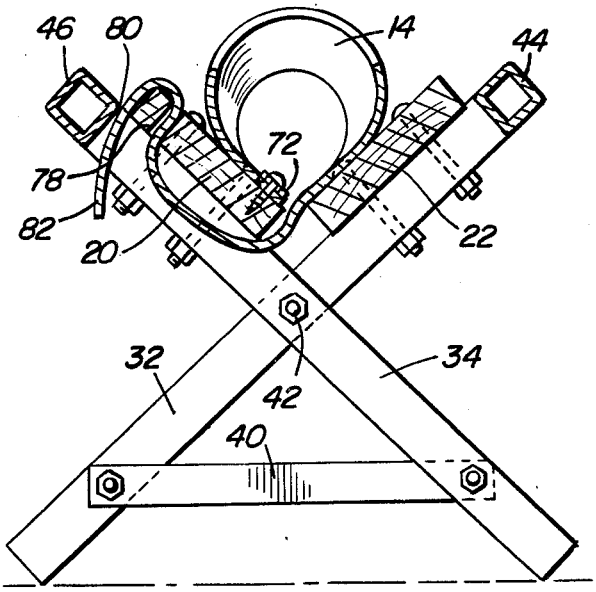
FIG. 4 is an enlarged transverse sectional view taken substantially upon a plane passing along section line 4—4 of FIG. 2, showing the device of the present invention.

Muzzle cone 14 is formed from flexible belting material, such as cotton, fiberglass, synthetic materials, or any other suitable flexible fabric or other material. The end of the fabric is held in place by a metal strip 72, such as can be formed from aluminum. Strip 72 is held in place by wood screws 74, passing through holes cut in strip 72, and then through the end of the fabric and into wooden platform 24. Metal strip 72 has a shape to provide slanted end edges 76 formed so as to match the angle of origin of fabric forming muzzle cone 14. The fabric forming muzzle cone 14 passes above wooden panel 22 in the form of a frusto-conical loop, and then beneath wooden panel 20 by passing down through the gap between the panels 20, 22 at the bottom of the V-shaped trough (see FIG. 4), then upwardly through slot 78 in wooden platform 20 and downwardly through the gap 80 between wooden panel 20 and longitudinal frame member 46. The end 82 of fabric comprising muzzle cone 14 can be easily adjusted by pulling on end 82 or feeding from end 82 through gap 80 to regulate the diameter of opening provided by muzzle cone 14, thereby adapting muzzle 14 to the size of animal to be placed in the device.

The method of using the device illustrated in FIGS. 1 to 5 is as follows. The device 10 is placed on a flat surface at the desired working level. Flexible muzzle cone 14 is adjusted by feeding of material from end 82 through gap 80 and slot 78 in the direction desired for adjusting muzzle cone 14 to approximate the size of the animal's head to be inserted therein. During adjustment of the size of muzzle cone 14, material will slip through slot 78, and binding of the material to conform with slot 78 and gap 80 allows a secure friction grip which maintains the desired opening in muzzle cone 14.

The animal to be placed in device 10 is grasped by its legs and turned to an upside down position with the operator's left hand holding the front legs and his right hand holding the back legs. The snout on the head of the animal is inserted into muzzle cone 14 and the front legs are released, freeing the operator's left hand. The left hand now holds the animal's back legs in the extreme forward position, and the right hand slides post 52 along frame member 44 so as to position horizontal retaining bar 18 immediately behind the hocks on the back legs of the animal. Set screw 62 can now be tightened and horizontal retaining bar 18 can be slid down to apply firm pressure upon the back legs of the animal. Tightening of set screw 68 completes the securing of the animal, which is now held in a substantially completely immobile state.

Veterinary operations made possible on animals when held in a completely immobile state by the device of the present invention include many routine surgical procedures, such as castration, hernia operations, body surgery, and suturing. Other medical operations can be performed as well, including innoculations, tail docking, ear notching or tagging, or teeth clipping. In addition, identification procedures, such as application of nose rings or tattooing can be performed. Furthermore, it is possible to perform a number of these operations sequentially upon the same animal while immobilized by the device of the present invention, or simultaneously by more than one operator.

Following completion of the desired veterinary operation or operations, the animal is removed from the device by an operator standing with the animal's head to the left. The operator grasps the back legs of the animal with the left hand, loosens set screw 68, and raises horizontal retaining bar 18 to remove pressure from the animal, which can then be lifted out from the device.

The present apparatus offers numerous advantages, such as complete adjustability for holding animals varying in size. The procedure outlined for use of the device of the present invention permits operation by a single person with savings in time of as much as 50 percent. The animal held by the device is rendered completely immobile, without injury or physical discomfort. The device can be located at any height or angle for the convenience of the operator, and both hands of the operator are free for performing veterinary operations. The device can be constructed from square steel tubing for the longitudinal frame members 46 and 44, as well as leg members 28, 30, 32, 34 and post 52. When so constructed, the device is relatively light in weight and completely portable, and other light weight materials, such as fiberglass, plastic, or other suitable materials can reduce the weight even further. When constructed as described, the device is relatively inexpensive and can be used repeatedly for long periods of time with little required maintenance. Parts which are subject to wearing out or require replacement for reasons of sanitation, such as muzzle cone 14, are easily replaced with use of simple and common hand tools.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A device for immobilizing an animal comprising a supporting framework, panels attached to said framework, an adjustable muzzle cone for securing the head of said animal, and attached to one of said panels and retaining means fastened by adjustable means to said framework, said retaining means being movable on said framework in the longitudinal direction of said animal to apply longitudinal force on the animal toward said muzzle cone, wherein said animal rests in a supine position on said panels and said adjustable means comprises a horizontal retaining bar, a horizontal adjusting means, and a vertical adjusting means, wherein said framework comprises two parallel pairs of upright crossed legs connected together to each other at the crossing, the pairs being connected by longitudinal frame members attached to the corresponding upper end of each leg, a pair of said panels being attached to said crossed legs in a V-shaped configuration, wherein said horizontal adjusting means comprises a horizontal sleeve capable of being tightened slidably on one of said longitudinal frame members, an upwardly projecting post being attached to said horizontal sleeve, and wherein said vertical adjusting means comprises a vertical sleeve capable of being tightened slidably on said post, said horizontal retaining bar being attached to said vertical sleeve for applying said longitudinal force, said horizontal sleeve being tightened on said longitudinal member by a set screw, said vertical sleeve being tightened on said post by a second set screw, and a vertically depending extension attached to the end of said horizontal retaining bar remote from said vertical sleeve, one of said panels being slotted and located on said framework to leave a gap between said slotted panel and one of said longitudinal frame members, said muzzle cone comprising flexible belting attached by attaching means at one end to said slotted panel and passing beneath said slotted panel and through the slot of said slotted panel, thence through said gap.

2. The device of claim 1 wherein said panels are wooden boards, said flexible belting is cotton web, said attaching means is an aluminum strip fastened through said web to said slotted panel by wood screws, and said legs, longitudinal frame members, and post are square steel tubing.

3. The device of claim 2 wherein said animal is a pig.

* * * * *